United States Patent [19]

Goldsmith et al.

[11] 4,345,520

[45] Aug. 24, 1982

[54] PORTABLE CAN CRUSHING APPARATUS

[75] Inventors: Norman Goldsmith, Saratoga, Calif.; Joseph W. Perrucci, 1135 Olive Branch La., San Jose, Calif. 95120

[73] Assignee: Joseph W. Perrucci, San Jose, Calif.

[21] Appl. No.: 229,649

[22] Filed: Jan. 29, 1981

[51] Int. Cl.[3] ..... B30B 9/32; B30B 1/04

[52] U.S. Cl. ..... 100/293; 100/295; 100/902

[58] Field of Search ..... 100/902, 293, 295; 241/99

[56] References Cited

U.S. PATENT DOCUMENTS

| | | | |
|---|---|---|---|
| 3,009,414 | 11/1961 | Griemert | 100/902 |
| 3,034,422 | 5/1962 | Howell | 100/902 |
| 3,062,130 | 11/1962 | Huber | 100/902 |
| 3,776,129 | 12/1973 | Carlson | 100/902 |
| 3,980,015 | 9/1976 | Woodard | 100/902 |
| 4,062,283 | 12/1977 | Kaminski | 100/902 |
| 4,088,072 | 5/1978 | Wittmeier | 100/902 |
| 4,133,261 | 1/1979 | Belfils | 100/902 |
| 4,143,595 | 3/1979 | Carlson | 100/902 |
| 4,168,661 | 9/1979 | Wigdahl | 100/902 |
| 4,188,875 | 2/1980 | Fabbri et al | 100/902 |
| 4,197,796 | 4/1980 | Salatka | 100/902 |
| 4,208,961 | 6/1980 | Okajima | 100/902 |
| 4,212,242 | 7/1980 | Willis | 100/902 |
| 4,213,387 | 7/1980 | McCaney et al | 100/902 |
| 4,265,170 | 5/1981 | Schulze | 100/902 |
| 4,290,354 | 9/1981 | Stevens | 100/902 |

*Primary Examiner*—Billy J. Wilhite

*Attorney, Agent, or Firm*—Flehr, Hohbach, Test, Albritton & Herbert

[57] ABSTRACT

A portable can crushing apparatus which is preferably also readily mountable to a horizontal or vertical support surface is disclosed herein. This apparatus includes a pair of spaced rods and a front end plate which together serve to support a can to be crushed. A back end plate is also provided and serves to support rearward ends of the rods and also the front edge of a holding plate which acts as a footrest during the can crushing operation. This latter operation is carried out by means of a crush plate mounted for slidable movement along the rods and a handle arrangement disposed between and connected with the crush plate and the back end plate.

8 Claims, 4 Drawing Figures

PORTABLE CAN CRUSHING APPARATUS

The present invention relates generally to an apparatus for crushing cans and more particularly to a can crushing apparatus (1) which is specifically designed to be portable and yet readily mountable for use on either a horizontal support surface or a vertical support surface, (2) which is relatively light weight and (3) which can be used with little effort whether it is operated in a portable unmounted manner or in a mounted manner on the floor or wall.

There are many different types of can crushing mechanisms described in the prior art. However, to Applicant's knowledge none combine portability with ease of operation while, at the same time, being readily mountable to either a horizontal or vertical support surface. On the other hand, the can crushing apparatus disclosed is one which includes these various features in its perferred embodiment. As will be seen hereinafter, this is accomplished by using a pair of spaced-apart parallel rods and a front end plate normal to and connected with the rods at its forwardmost ends for supporting the can to be crushed. A back end plate is connected with and supports the rearwardmost ends of the rods while a mounting plate is connected to and extends rearwardly of the back end plate in a plane parallel with and below the rods so as to serve as a footrest for maintaining the end plate and rods in place as a can is crushed, without the necessity of mounting the apparatus in place.

In order to actually crush a can, the apparatus includes a crush plate mounted for slidable movement along the rods in confronting relationship with the front end plate and also handle means located between the back end plate and crush plate for moving the latter towards and away from the front end plate.

The overall can crushing apparatus disclosed herein will be described in more detail hereinafter in conjunction with the drawing, wherein.

Figure 1:
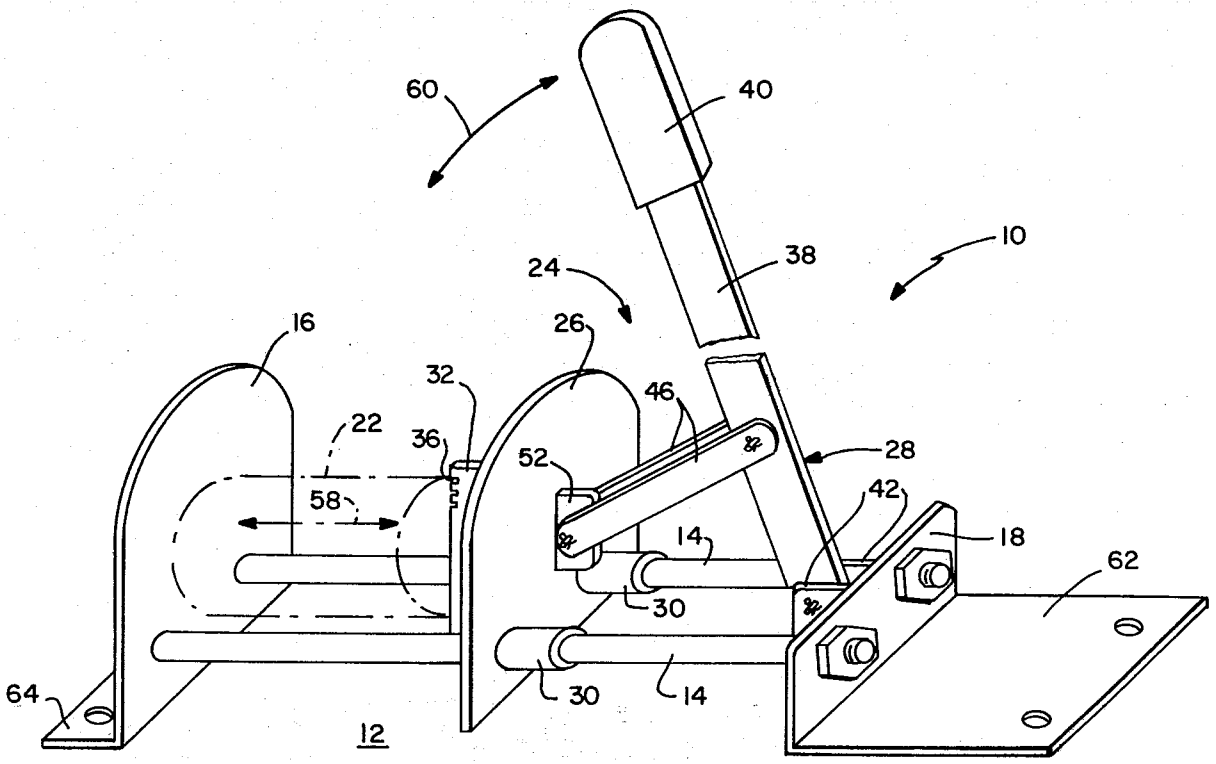
FIG. 1 is a perspective view of the apparatus designed in accordance with the present invention and shown in a portable, unmounted position.
Figure 3:
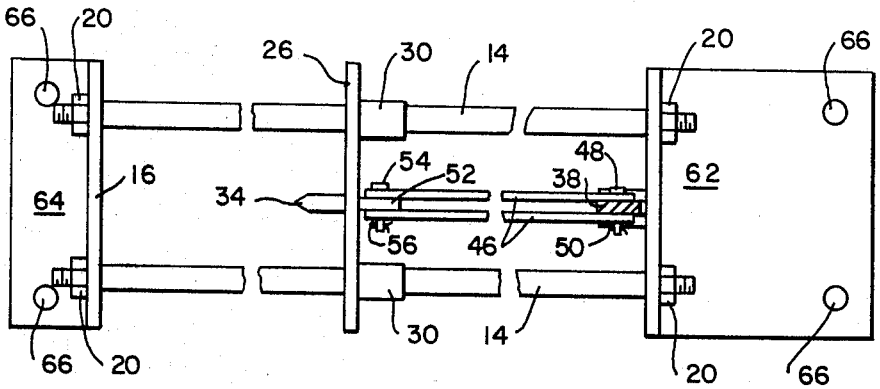
FIG. 3 is a top plan view of the apparatus of FIGS. 1 and 2.
Figure 2:
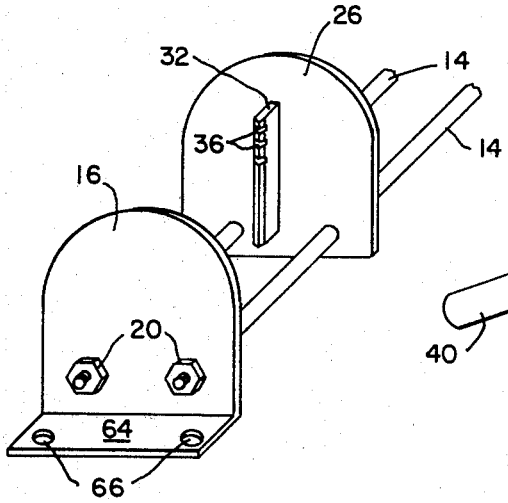
FIG. 2 is a different perspective view of the apparatus illustrated in FIG. 1.

Turning now to the drawing, wherein like components are designated by like reference numerals throughout the various figures, attention is first directed to FIGS. 1–3. In these figures, a portable can crushing apparatus generally indicated at 10 is illustrated in an unmounted position on a horizontal support surface 12. As will become apparent hereinafter from the following detailed description, apparatus 10 is designed to be small and light weight, e.g., portable, and yet it requires little effort to crush a standard aluminum or the like beer or soda pop can. At the same time, the apparatus is one which can be readily mounted in place, either to the horizontal support surface 12 or to a vertical support surface, as will be discussed hereinafter with respect to FIG. 4.

As seen best in FIG. 1, apparatus 10 includes a pair of spaced-apart parallel rods 14 which preferably have circular outer cross-sections and which extend in a common horizontal plane just above surface 12. The forwardmost ends of the rods are supported by and connected with a front end plate 16 which extends vertically upward from support surface 12 in a plane normal to rods 14. The rearwardmost ends of the rods 14 are connected with and supported by a back end plate 18 which extends vertically upward from support surface 12 in a plane parallel with plate 16. As seen best in FIG. 3, opposite threaded end sections of each rods extend through cooperating, aligned openings in plates 16 and 18. Nuts 20 are mounted around these threaded ends for fixedly attaching the rods and plates with one another.

As best illustrated in FIG. 1, the rods 14 and front end plate 16 serve to support a can to be crushed which is generally indicated by dotted lines at 22 on and between the rods with one end of the can resting against the front end plate. With the can in this position, a mechanism 24 comprising part of the overall apparatus is provided for crushing the can against the front end plate. As will be seen below, this mechanism includes a crush plate 26 mounted for slidable movement along rods 14 in confronting relationship with front end plate 16 and a handle arrangement 28 located between the crush plate and back end plate 18 for moving the crush plate towards and away from the front end plate.

Crush plate 26 is disposed in a plane parallel with the front and back end plates 16 and 18 and include cooperating holes through which rods 14 extend for slidably supporting the crush plate. In order to guide the crush plate in its movement along rods 14, a pair of cylindrical guides or sleeves 30 are disposed around the rods and fixedly connected to the rearward face of crush plate 26. In order to aid in crushing can 22, the front face of crush plate 26 is provided with a connected, elongated wedge 32. This wedge extends vertically across and projects out from the front face of crush plate, as best seen in FIG. 2, and includes a forwardmost edge 34 which tapers to a dull edge, as best seen in FIG. 3.

As will be seen hereinafter, once can 22 is positioned in the manner illustrated in FIG. 1, it may be crushed by moving crush plate 26 against the back end of the can and towards front end plate 16. Wedge 32 serves to collapse the wall of the can during initial movement of plate 26 in order to make the crushing operation easier. At the same time, the wedge is provided with a number of grooves or serrations 36 which are located at its top edge. These grooves or serrations serve to receive an edge of the back end of can 22 for aiding in maintaining the can in place as the latter is crushed. It is particularly helpful in preventing the can from slipping out of position during initial movement of the crush plate.

Referring specifically to FIG. 1, handle arrangement 28 is shown including an elongated handle 38 having a free top end carrying a hand gripper 40. The bottom end of handle 38 is pivotally connected to the front face of back end plate 18 at a location centrally between rods 14. In order to provide this pivotal connection, a pair of spaced brackets 42 are fixedly connected to the front face of plate 18. The bottom end of handle 38 is disposed between these brackets and a pivot pin 44 is disposed through cooperating openings in the brackets and handle and are locked in place by suitable means, for example a lock pin (not shown). Handle arrangement 28 also includes a pair of confronting, spaced apart elongated links 46 pivotally connected at their rearward ends to handle 38 at an intermediate point on the latter and at their forward ends to the back face of crush plate 26 just above and centrally located between the cylindrical sleeves 30. As best seen in FIG. 3, the rearward ends of links 46 are pivotally connected to handle 38 by means of a suitable pivot pin 48 and lock pin 50. The forward ends of the links are pivotally connected to the crush plate by means of a single bracket 52 which is fixedly connected to and which projects out from the back face of the crush plate. More specifically, the rearward ends of links 46 are pivotally disposed on either side of the bracket 52 and a pivot pin 54 is disposed through cooperating openings in the link and bracket and held in place with a lock pin 56.

Having described overall handle arrangement 28, it should be apparent that the latter serves to slidably move crush plate 26 along rods 14, (in the direction of the two way arrow 58) by pivoting handle 38 back and forth, as indicated by two way arrow 60. In a preferred embodiment, the overall apparatus is portable and the handle 38 is positioned such that the crush plate can be located in the position illustrated in FIG. 1 for standard 12 ounce cans while, at the same time, allowing a limited amount of rearward movement for crushing larger cans. In either case, the size and position of the handle arrangement should be such that the crush plate is movable in close proximity to plate 16. In this regard, plate 16 is preferably thicker than crush plate 26 and the back end plate so as to maintain its structural integrity. Moreover, when the crush plate is in its forwardmost position, there is preferably a small space between it and plate 16, to prevent the possibility of an injury during the absence of a can.

In addition to the various features thus far described, overall can crushing apparatus 10 includes a holding or mounting plate 62 which is fixedly connected to and which extends rearwardly of back end plate 18 in a plane parallel with and below rods 14. In this way, the holding plate serves as a footrest for maintaining the rest of the apparatus and particularly the end plates and rods in place as can 22 is crushed. More specifically, an individual wanting to crush can 22 without fixedly mounting apparatus 10 to a support surface needs merely to step on plate 62 behind plate 18 while, at the same time moving handle 38 forward and downward. In this regard, when crush plate 26 is positioned in the manner illustrated in FIG. 1, that is, against a rearward end of can 22, before the latter is crushed, handle 38 preferably extends upward at a slight forward angle to plate 18. In this way, the individual operating apparatus 10 always pushes in a downwardly inclined direction when crushing the can. This is to be contrasted with a handle which is disposed in an upward and rearward direction relative to plate 18 which would require the operator to first push in an upwardly inclined direction which tends to be more difficult than pushing in the downwardly inclined direction. In this regard, it may be desirable to initially maintain the handle in a position parallel with plate 18, as a compromise, so that the operator does not have to bend forward to as great a degree as the handle is moved in the forward direction.

The final component making up apparatus 10, as illustrated in FIGS. 1–3, is a second mounting plate 64 which is fixedly connected to and extends forwardly of front end plate 16 in the same plane as holding first mounting plate 62. Both the second mounting plate and the holding or first mounting plate serve to fixedly connect the overall apparatus 10 to a corresponding support surface, for example surface 12. To this end, each of these plates includes through holes 66 which are adapted to receive mounting bolts or other suitable mounting devices (not shown in FIG. 3).

Figure 4:
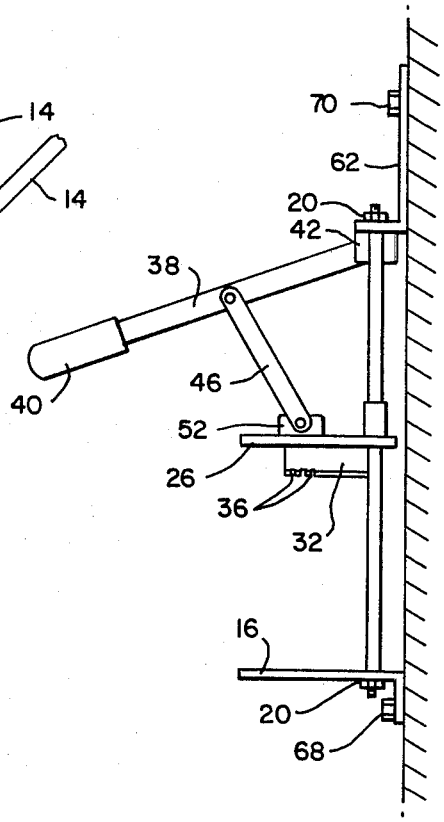
FIG. 4 is a side elevational view of the apparatus of FIGS. 1–3 shown in the mounted position against a vertical support surface.

Overall can crushing apparatus 10 has been described thus far in an operating position on support surface 12, that is, on a horizontally extending support surface. However, in FIG. 4 the apparatus is shown mounted to a vertical support surface 68 by means of suitable bolts or the like 70 extending through holes 66 and into surface 68 with the plates 62 and 64 resting against the vertical support surface. The apparatus is specifically positioned such that plate 62 is directly vertically above plate 64 so that the can to be crushed is actually supported by plate 16 rather than the rods 14. The utilization of previously described serrations or grooves 36 in wedge 32 become more important in this case since the can is otherwise likely to slip during the initial crushing operation. In addition, when the apparatus is mounted vertically as shown in FIG. 4, it is preferable to mount the apparatus at about waist high of the operator with the handle 38 being disposed at the downward angle shown in FIG. 4 or at most horizontally (but not at an upwardly extending angle) so that the operator can easily push down on the handle during the crushing operation.

What is claimed is:

1. A portable can crushing apparatus comprising:

(a) means including a pair of spaced-apart parallel rods and a front end plate normal to and connected with said rods at forwardmost ends of the latter for supporting a can to be crushed on and extending between said rods with one end of the can resting against said front end plate;

(b) a back end plate connected with and supporting rearwardmost ends of said rods;

(c) can crushing means including a crush plate mounted for slidable movement along said rods in confronting relationship with said front end plate and handle means located between said crush plate and back end plate for moving said crush plate towards and away from said front end plate, whereby to crush said can; and (d) a holding plate connected to and extending rearwardly of said back end plate in a plane parallel with and below said rods so as to serve as a footrest for maintaining the end plates and rods in place as a can is crushed on a horizontal support surface.

2. An apparatus according to claim 1 including a front mounting plate connected to and extending forwardly of said front end plate in the same plane as said holding plate whereby the latter and said front mounting plate serve to mount the rest of the apparatus to a vertical support surface for crushing cans.

3. An apparatus according to claim 1 wherein said handle means includes an elongated handle having a first free end and a second end pivotally connected to said back end plate and an elongated link, one end of which is pivotally connected to an intermediate point along the length of said handle and an opposite end of which is pivotally connected to said crush plate whereby pivotal movement of said handle causes said crush plate to move along said rods.

4. An apparatus according to claim 1 wherein said rods are circular in cross section, said apparatus including a pair of cylindrical guides disposed around and being slidable along said pair of rods, said guides being connected with and extending rearwardly of said crush plate for supporting the latter along said rods.

5. An apparatus according to claim 1 wherein said crush plate has a front flat face parallel with and confronting said front end plate, said apparatus including an elongated wedge connected to and extending substantially centrally across the front face of said crush plate for aiding in crushing a can.

6. An apparatus according to claim 5 wherein said wedge includes grooves positioned thereon for receiving an edge of the back end of a can being crushed for aiding in maintaining the can in place.

7. A can crushing apparatus comprising:

(a) means including a pair of spaced-apart parallel rods having circular cross-sections and a front end plate normal to and connected with said rods at forwardmost ends of the latter for supporting the can to be crushed on and extending between said rods with one end of the can resting against said front end plate;

(b) a back end plate connected with and supporting rearwardmost ends of said rods;

(c) can crushing means including (i) a crush plate mounted for slidable movement along said rods in confronting relationship with said front end plate, (ii) a pair of cylindrical guides respectively disposed around said pair of rods, said guides being connected to and extending rearwardly of said crush plate for slidably supporting the latter along said rods, (iii) an elongated wedge connected to and extending substantially centrally across the front face of said crush plate in confronting relationship to said front end plate whereby to aid in crushing a can, said wedge including grooves positioned thereon for receiving an edge of the back end of a can being crushed for aiding in maintaining the latter in place, and (iv) handle means located between said crush plate and said back end plate for moving said crush plate towards and away from said front end plate whereby to crush said can, said handle means including an elongated handle having a first free end and a second end pivotally connected to said back end plate and an elongated link, one end of which is pivotally connected to an intermediate point along the length of said handle and an opposite end of which is pivotally connected to said crush plate, whereby pivotal movement of said handle causes the crush plate to move along said rods;

(d) a holding plate connected to and extending rearwardly of said back end plate in a plane parallel with and below said rods so as to serve as a footrest for maintaining the end plates in place as a can is crushed on a horizontal support surface, said holding plate including a plurality of through holes whereby to serve as a mounting bracket adapted to being bolted in place against either a horizontal surface or a vertical surface; and (e) a front mounting plate connected to and extending forwardly of said front end plate in the same plane as said holding plate, said front mounting plate including a plurality of through holes so as to be adapted to be bolted in place along with said holding plate to either a horizontal support surface or a vertical support surface.

8. An apparatus according to claim 7 wherein said handle is located at an acute angle with and forward of said back end plate when a standard 12 ounce can is supported on said rods and against said front end plate and said crush plate is located against the back end of said can before the latter is deformed in any way.

* * * * *